United States Patent [19]

Mannio

[11] Patent Number: 5,035,196

[45] Date of Patent: Jul. 30, 1991

[54] APPARATUS FOR CONTROLLING THE TILT ANGLE OF A DOCTOR BLADE

[75] Inventor: Aaron Mannio, Järvenpää 050351550, Finland

[73] Assignee: Valmet Paper Machinery Inc., Helsinki, Finland

[21] Appl. No.: 459,359

[22] Filed: Dec. 29, 1989

[30] Foreign Application Priority Data

Dec. 30, 1988 [FI] Finland ..... 886062

[51] Int. Cl.[5] ..... B05C 11/04

[52] U.S. Cl. ..... 118/126; 118/123; 427/356

[58] Field of Search ..... 118/123, 126, 261, 413, 118/708, 240, 107; 427/356

[56] References Cited

U.S. PATENT DOCUMENTS

| | | | |
|---|---|---|---|
| 3,149,005 | 9/1964 | Brundige | 118/126 |
| 3,187,718 | 6/1965 | Coghill | 118/126 |
| 3,245,378 | 4/1966 | Caple et al. | 118/126 |
| 4,637,338 | 1/1987 | Wöhrle | 118/126 |
| 4,907,529 | 3/1990 | Mannio | 118/126 |

FOREIGN PATENT DOCUMENTS

| | | |
|---|---|---|
| 220374 | 12/1978 | Finland . |
| 793164 | 12/1982 | Finland . |
| 844035 | 2/1988 | Finland . |

*Primary Examiner*—James C. Housel

[57] ABSTRACT

An apparatus for controlling the tilt angle of a doctor blade (12) includes two support blocks (2) of a doctor blade supporting beam (7), a first actuator (3, 4) by which the supports (2) are movable about on their bearing points (1), a blade supporting beam (7) pivotally mounted between upper parts of the support blocks (2) having a doctor blade (12) attached to the beam, and a second actuator (11) by which the blade supporting beam (7) is movable about on its pivoting point (8) in order to control the tilt angle and loading of the blade (12). Between the support blocks (2), an axle (28, 41) is pivotally mounted which is arranged via a transfer apparatus to rotate essentially in the same way as the blade support beam (7), at least one guiding member (24, 42) is eccentrically attached to the axle (28, 42), and the first actuator (3, 45) is arranged to rest against the guiding member (24, 42), whereby the eccentricity of the guiding member (24, 42) causes the rotation of the supporting blocks about the bearing points (1), when the blade supporting beam (7) is rotated around the bearing point (8) with the help of the second actuator (11) whereby it is possible to maintain a constant tip angle during any changes in the blade loading.

6 Claims, 3 Drawing Sheets

APPARATUS FOR CONTROLLING THE TILT ANGLE OF A DOCTOR BLADE

BACKGROUND AND SUMMARY OF THE INVENTION

The present invention relates to an apparatus for controlling the tilt angle of a doctor blade.

In doctor blade applicators, the amount of coating mix applied to the web is controlled by adjusting the loading of the blade. However, changes in the degree of blade loading also cause a change in the blade's tilt angle, which complicates blade control.

In prior art doctoring units, the blade position has been manually adjusted as required. Compensation systems for blade tilt angle are also known. Finnish patent application 844035 discloses an apparatus in which two synchronously operated jacks are used to set the degree of blade loading. Finnish patent application 793164 discloses an apparatus in which loading control is effected by adjusting the shape of the blade while the blade supporting beam is stationary. In this case, the blade supporting beam incorporates a complicated control system for the adjustment of blade stiffness. In a system described in Finnish patent application 2203/74, loading control is achieved by rotating the blade frame about a shaft, thus causing a deformation of the blade shape and simultaneously altering the reaction force of the blade, while maintaining a constant blade tilt angle.

Manual blade control by methods of conventional technology is slow and incapable of complying with all loading conditions, which results in undesired deviations in the amount of coating mix applied. Compensation systems for doctor blade tilt angle deviations known in the art are complicated in structure, high in cost, and prone to malfunction. Also the control accuracy is often inadequate.

The aim of the present invention is to overcome the disadvantages associated with the aforedescribed prior art technology and achieve a totally new kind of apparatus for controlling the tilt angle of a doctor blade.

The present invention is based on designing a pivotally mounted structure of the doctor blade's supporting beam which abuts, via a lever arrangement, against the blade load adjusting device so that the rotation of the beam moves the beam closer to the web, thus increasing the blade loading, while the angle included by the blade tip and a tangent drawn to the contacting point of the tip is maintained constant or controlled in a desired manner.

The invention provides outstanding benefits.

The blade tilt angle controlling apparatus achieves, by means of an apparent adjustment (rotating the beam) of tilt angle, a change in the blade loading while the actual tip angle remains exactly constant, thus simplifying the adjustment of the coating mix application and additionally a better quality of the coating is achieved in transformation situations.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is next examined in detail with help of exemplifying embodiments illustrated in the attached drawings which are given by way of illustration only, and thus are not limitative of the present invention and wherein.

DETAILED DESCRIPTION OF THE PREFERRED EMBODIMENTS

Figure 1:
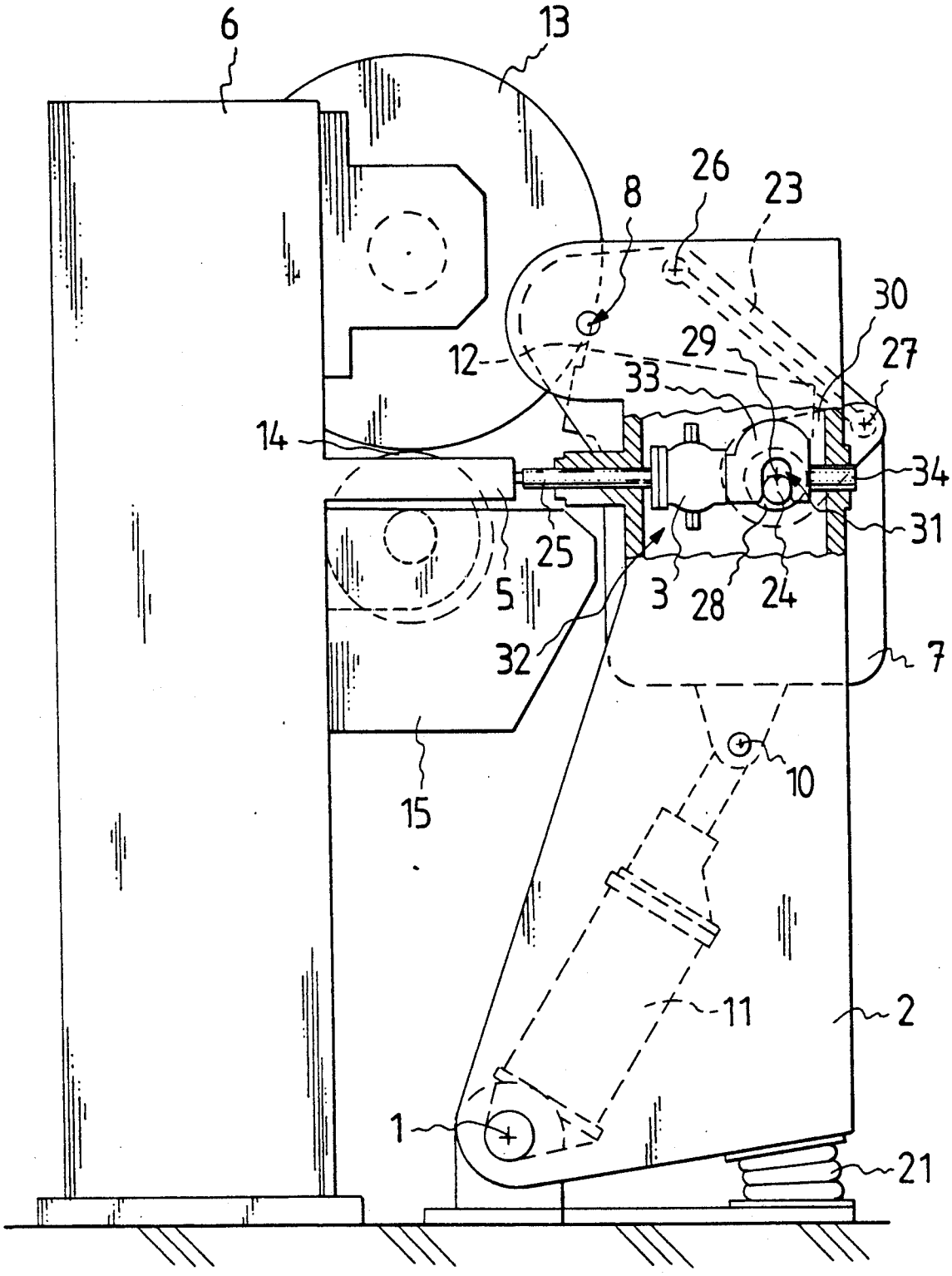
FIG. 1 is a partially longitudinally sectioned side view of a coating mix applicator utilizing a tilt angle control apparatus in accordance with the present invention.

According to FIG. 1, the frame of the doctor blade unit in the coating mix applicator is formed by lever-like support blocks 2 of a beam 7 pivotally mounted on a base at both sides of the applicator by bearing points 1. The support blocks 2 are elevated into their operating positions by means of lift actuators 21 mounted to the base. The doctor blade supporting beam 7 which supports a doctor blade 12, is located between the support blocks 2 and is pivotally mounted to their upper parts close to a backing roll 13 at a bearing point 8. Correspondingly, the backing roll 13 is pivotally mounted to the upper part of an applicator's frame 6. Under the backing roll 13, in conjunction with a coating mix trough 15, an applicator roll 14 is attached. The support blocks 2 of the blade beam are movable about a bearing point 1 by means of a load pusher 32 leaning on a support column 5. The load pusher 32 comprises a push rod 25, which is further connected to a screw jack 3. At the other end of the screw jack 3 is fixed a guide part 33, which comprises a vertical guide groove 31. In addition, at the end of the guide part 33 is a support rod 34. The rods 25 and 34 are used as bearings for attaching the load pusher 32 horizontally movable to the support block 2. The load pusher 32 leans with its guide groove 31 on a guide roll 24 and thereby indirectly on the support block 2. The guide rolls 24 are namely eccentrically attached with rolling bearings from their center points to both ends of an axle 28. The outer surface of the axle 28 acts as a bearing area between the axle 28 and the support block 2. With the help of the screw jack 3, the basic regulation of the tilt angle can be carried out with this structure. The rotation of the axle 28 corresponds with ratio 1:1 to the rotation of the blade supporting beam 7 about the point 8. The rotational movement is carried out by levers 23 and 30 such that the lever 23 pivotally mounted at its first end to the upper part of the supporting beam 7 at a bearing point 26, is pivotally mounted at its other end to the lever 30 at a bearing point 27. On the other hand, the lever 30 is fixed to the axle 28, whereby the other bearing point of the lever 30 is the bearing center point 29 of the axle 28. The bearing points 29, 27 and 26 of the levers together with the bearing point 8 of the supporting beam form a parallelogram, whereby a rotation relation is attained of ratio 1:1.

The bearing point 8 of the blade beam 7 is located close to the tip of the doctor blade 12. Adapted at a bearing point 10 to the lower part of the blade beam 7 is another screw jack 11, which is pivotally mounted at its lower end to a bearing point 1 of the support block 2 of the blade beam 7. With the help of the second screw jack 11, the blade beam 7 is rotatable about its bearing point 8 so that a counterclockwise rotation of the blade beam 7 (for the case illustrated in the figure) tends to increase the blade's tilt angle, but because the axle 28 regulated by the levers 30 and 23 turns counterclockwise and thereby the guide roll 24 guides the support block 2 and at the same time the blade beam 7 with its blade 12 closer to the backing roll 13, thus maintaining a constant tilt angle of the blade.

In the embodiment illustrated in FIG. 1, a straight shaped guiding groove 31 is used, however, curved grooves can also be utilized. In the presented case, the diameter of the guiding roll 24 is about 80 mm and the displacement from the central bearing point of the axle 28 is about 20 mm. The distance as well as the transmission ratio of the lever arrangement can be varied to comply with the length of the doctor blade 12 and the supporting method applied.

Figure 2:
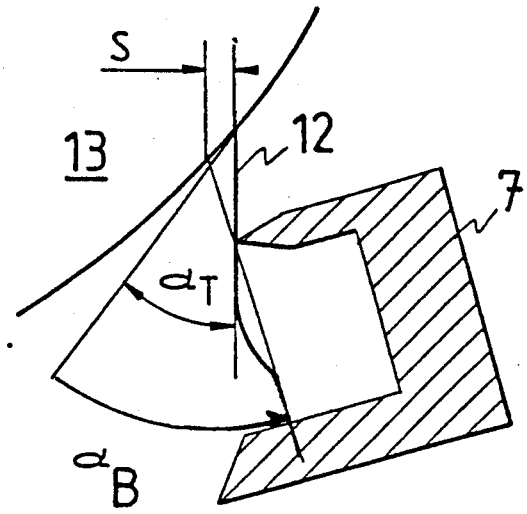
FIG. 2 is a partially longitudinally sectioned side view showing the operation of the doctor blade unit of the applicator illustrated in FIG. 1.
Figure 3:
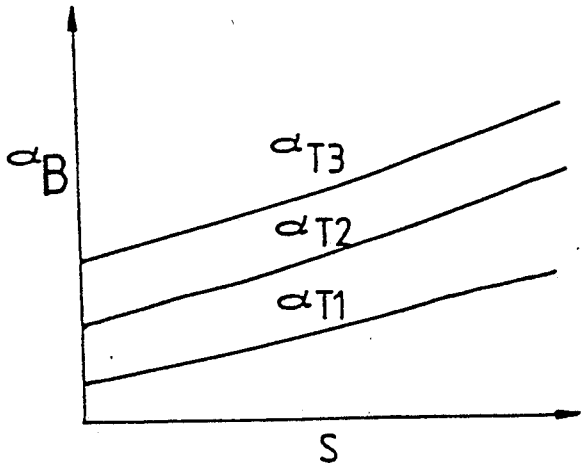
FIG. 3 is a graph of the dependence of the doctor blade tip angle on the rotation and loading of the blade beam.

According to FIGS. 2 and 3, each steplessly adjustable setting of the first lift actuator 3 corresponds to a certain rotation angle aB of the beam 7 about the bearing point 8, at which angle the contact between the tip of the doctor blade 12 and the backing roll 13 (with a loading $s=>0$) is established. The value of the blade tilt angle $\alpha T$ is determined by the contact of the tip of the blade 12 with the surface of the roll 13. After a contact is established (with a loading $s=>0$), an increase in the rotation angle of the beam 7 about the point 8 results in a smoothly increasing value of the loading s while the value of the tip contact angle $\alpha T$ stays constant. Control for degree of loading during run is effected by rotating the beam 7 about its bearing point 8 with the help of the second actuator 11. During run, the first actuator 3 will not be used. In practice, loading s is defined as the distance of the bearing point 8 of the blade beam 7 to the applicator's frame 6 so that the zero distance is defined as the position where the blade 12 is not loaded and the tip of the blade 12 just makes contact with the backing roll 13.

Figure 4:
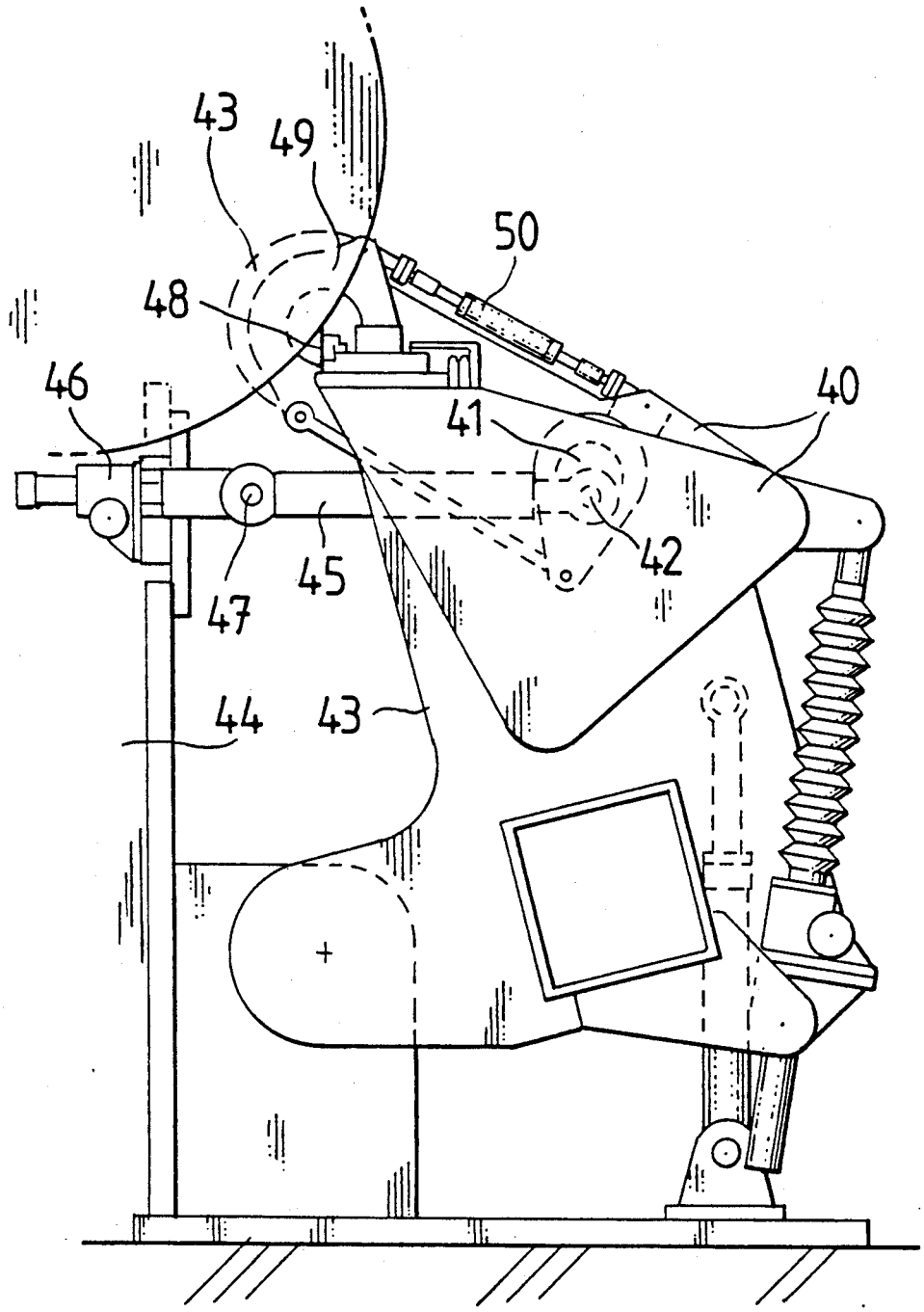
FIG. 4 is a cross-sectional side view of an alternative embodiment in accordance with the invention.

FIG. 4 is a cross sectional view along the machine center line. In accordance with the figure, in order to adjust the blade 48 a crank shaft with the bearings is attached to both support blocks 43. The crankshaft 41 is movable with the help of a transmission apparatus essentially in accordance with the FIG. 1. Additionally, the position of the lever parallelogram can be controlled by a rod 50 with an adjustable length. The rod 50 is pivoted between the blade supporting beam 40 and a disc 49 attached with bearings to the supporting block 43 at the point uniting with the tip of the blade 48. The shaft 41 is attached with bearings to the support block 43, whereby the transmission apparatus is between the support block 43 and the blade supporting beam 40. Both the crank part 42 and the connecting rod 45 are inside the support block 43. The length of the shaft 41 in direction of the blade supporting beam 40 is about 400 mm.

The connecting rod 45 pivoted to the eccentric crank part 42 of the shaft 41 transfers the movement of the crank part 42, caused by the rotation of the shaft 41, to the frame 44 via a bearing point 47 at the frame end of the rod 45.

The basic adjustment of the angle of the support block 43 as well as the tip angle can be carried out by a screw jack 46 connected to the bearing point 47 positioned at the frame side of the rod 45, the combination of the screw jack 46 and the rod 45 acting as the first transfer means.

The first transfer means 3 in accordance with FIG. 1 can alternatively be positioned at the frame 6 side acting via a stiff transfer rod to a load pusher connected to the support block 2.

The function of the levers 23, 30 can be carried out, e.g., with the help of belt pulleys and belts or alternatively by means of a programmable logic controller attached to the first actuator 3, thus making the control variable of the actuator to be determined by a mathematical function related to the position of the second actuator 11. In this embodiment absolute position sensors may be used for controlling the distance of the upper end of the support block 2 from the frame 6 and an angle sensor for controlling the angle of the blade beam. Alternatively the extensions of the screw jacks 3 and 11 may be controlled by position sensors.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for controlling tilt angle of a doctor blade relative to a backing roll, the apparatus comprising:

two support blocks pivotally mounted on a base about first bearing points;

a doctor blade supporting beam pivotally mounted to an upper part of the support blocks, the blade supporting beam having a doctor blade attached thereto;

a first actuator movable with the support blocks about the first bearing points in order to adjust positioning of the doctor blade relative to the backing roll;

a second actuator rotatable with the blade supporting beam about second bearing points for adjusting degree of loading and tilt angle of the doctor blade relative to the backing roll;

an axle pivotally mounted to the support blocks, the axle being spaced from the second bearing points;

transfer means for moving the axle essentially in a same direction that the blade supporting beam is moved; and at least one guiding member eccentrically attached to the axle, the first actuator being positioned against the at least one guiding member whereby eccentricity of the at least one guiding member causes pivoting of the support blocks about the first bearing points when the blade supporting beam is pivoted about the second bearing points by the second actuator.

2. The apparatus for controlling tilt angle in accordance with claim 1, wherein the transfer means comprises a first and second lever, the first lever being pivoted at a first end thereof to an upper part of the blade supporting beam at a third bearing point, the first lever having a second end which is pivotally attached to a first end of the second lever, the second lever having a second end which is fixed to the axle, the axle having a bearing center point which is also a bearing point of the second end of the second lever.

3. The apparatus for controlling tilt angle in accordance with claims 1 or 2, wherein the first actuator comprises a load pusher having a screw jack and a guide part, the load pusher being horizontally attached to the support blocks by bearings, the guide part being fixed to the screw jack, and the guide part having a guide groove defined therein, the at least one guiding member resting in the guide groove and causing pivoting of the support blocks.

4. The apparatus for controlling tilt angle in accordance with claim 3, wherein the guide groove has a generally straight shape.

5. The apparatus for controlling tilt angle in accordance with claim 2, wherein the bearing center point of the axle, the second bearing point, the third bearing point and a bearing point at the pivotal connection of the first and second levers form corners of a parallelogram such that a transfer ratio of the transfer means is generally 1:1.

6. The apparatus for controlling tilt angle in accordance with claim 1, wherein the first and second actuators are screw jacks.

* * * * *